US008505243B2

(12) United States Patent
Tenute

(10) Patent No.: US 8,505,243 B2
(45) Date of Patent: Aug. 13, 2013

(54) RAIN GUTTER PROTECTING DEVICE WITH ROOF-MATCHING COATING

(76) Inventor: Steven J. Tenute, Naperville, IL (US)

( * ) Notice: Subject to any disclaimer, the term of this patent is extended or adjusted under 35 U.S.C. 154(b) by 1078 days.

(21) Appl. No.: 11/768,492

(22) Filed: Jun. 26, 2007

(65) Prior Publication Data

US 2009/0000209 A1 Jan. 1, 2009

(51) Int. Cl.
*E04D 13/00* (2006.01)

(52) U.S. Cl.
USPC ..... 52/11; 52/12

(58) Field of Classification Search
USPC ..... 52/11, 12
See application file for complete search history.

(56) References Cited

U.S. PATENT DOCUMENTS 5,457,916 A * 10/1995 Tenute ..... 52/12
7,119,135 B2 * 10/2006 Neimann ..... 524/34

OTHER PUBLICATIONS

How Products Are Made—Shingles, Mar. 26, 2006, vol. 3. http://www.madehow.com/Volume-3/Shingle.html.*

* cited by examiner

*Primary Examiner* — Andrew Triggs
(74) *Attorney, Agent, or Firm* — Barnes & Thornburg LLP

(57) ABSTRACT

A device for covering and protecting a rain gutter to prevent debris, vermin and other material from entering the gutter and accumulating therein. The device includes an elongated body having an apertured trough oriented downwardly into a rain gutter, and a roof-matching coating on an upper surface of the body. The coating comprises granules embedded in a substrate secured to the body. A clear top coat can overlap the roof-matching coating.

11 Claims, 1 Drawing Sheet

RAIN GUTTER PROTECTING DEVICE WITH ROOF-MATCHING COATING

BACKGROUND OF THE INVENTION

This invention relates to rain gutter protection devices, and in particular to a device for completely covering a rain gutter to prevent debris, vermin and other material from entering the gutter, while freely allowing water to enter. The invention relates particularly to a rain gutter protection device having a roof-matching coating of an upper surface of the device.

As explained in my earlier U.S. Pat. No. 5,457,916, the disclosure of which is incorporated herein by reference, homes and other buildings, when having a pitched roof, typically are built with a rain gutter used to collect rain water from the roof and direct that water away from the building structure. Gutters usually lead to downspouts from which water is then channeled away from the structure as desired. Many different types of gutter protection devices have been developed over the years.

In the past, gutter protecting devices have been formed of metal, plastic or other similar materials, and may or may not be of a color which matches the existing roof or gutter or adjacent building structure. Whatever the material of the gutter cover, a common feature of prior gutter covers is that they present smooth upper surfaces over which water sheets when flowing into a gutter.

SUMMARY OF THE INVENTION

The invention is directed to a rain gutter protecting device comprising an elongated, continuous body adapted to be affixed proximate a roof and to extend outwardly from the roof over a rain gutter secured along one edge of the roof, and including an apertured trough oriented downwardly into the rain gutter. A roof-matching coating is provided on an upper surface of the body, the coating comprising granules embedding in a substrate secured to the body.

In accordance with the preferred form of the invention, the granules are stone. The substrate may be an adhesive, and the adhesive can be self-carrying or heat-cured. In accordance with the preferred form of the invention, the adhesive is an acrylic or may be asphalt. A clear top coating may be applied, overlying the roof-matching coating.

The coated rain gutter protecting device is formed by the steps of first fabricating the continuous body, and then applying the roof-matching coating to the upper surface of the body. That step first involves applying the substrate to the upper surface, followed by embedding granules in the substrate. Depending on the nature of the material of the substrate, the further step of heat-curing the body occurs after embedding the granules. Finally, if a clear top coat is desired, it is applied over the roof-matching coating as a final step.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
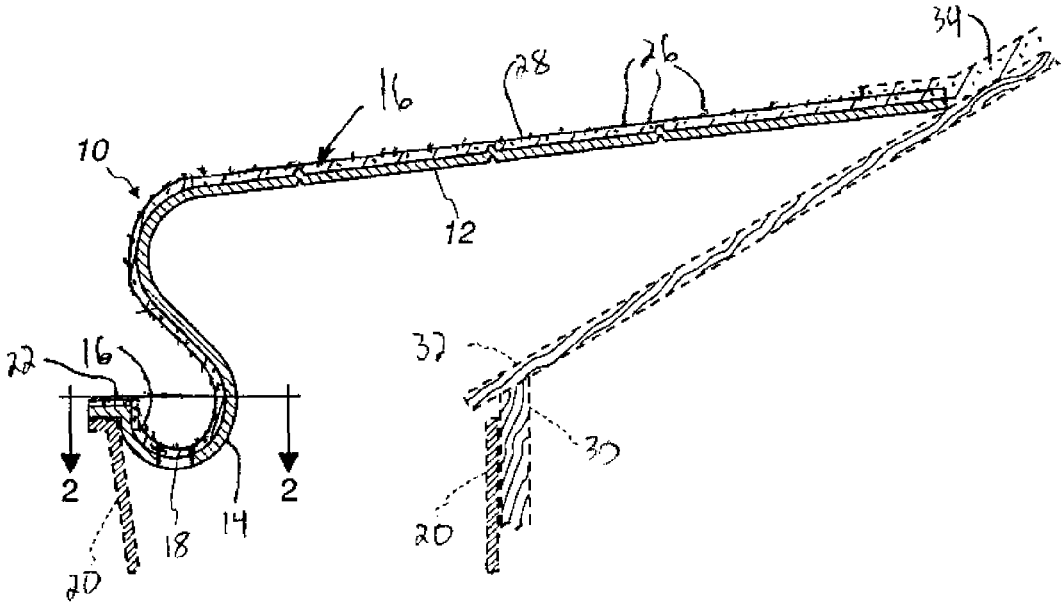
FIG. 1 is an elevational cross-section of a rain gutter protecting device according to the invention, exaggerated in thickness and shown in relation to portions of a building structure and gutter, which are shown in phantom.

A rain gutter protecting device according to the invention is shown generally at 10 in the drawing figures. The rain gutter protecting device comprises an elongated, continuous body 12 including an apertured trough 14, and a roof-matching coating 16 on an upper surface of the body 12.

Figure 2:
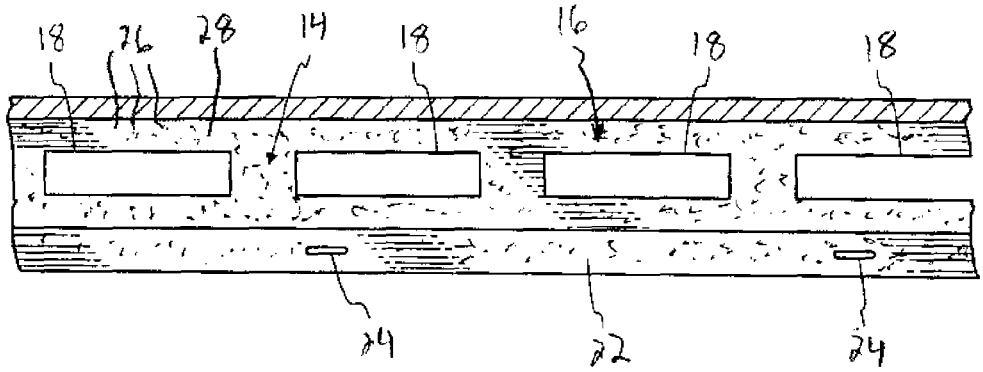
FIG. 2 is a cross-sectional illustration taken along lines 2-2 of FIG. 1, showing the trough portion of the rain gutter protecting device of the invention.

As best shown in FIG. 2, the trough 14 includes a plurality of spaced, elongated slots 18 which are shaped to emit water from the trough 14 into a gutter 20 extending therebeneath. The slots 18 are shown generally rectangular in shape, although other shapes can be employed. The slots are formed to accommodate rain water flow from a roof, while still inhibiting dirt, debris and other material from entering the slots 18. While not mandatory, preferably the trough 14 extends somewhat within the gutter 20 while still not forming a structure sufficient to capture and hold debris and other material therewithin.

An outwardly extending flange 22 is intended to be secured to the gutter 20. As shown in FIG. 2, the flange 22 is provided with a series of oval apertures 24 through which screws, bolts, rivets or other fasteners can be passed to secure the flange 22 to the gutter 20. Other means of fastening will be apparent to those skilled in the art.

The roof-matching coating 16 is preferably composed of granules 26 embedded in a substrate 28 secured to the body 12. The granules can be any type of robust granule, such as crushed stone, synthetic stone, fiberglass or similar materials. The substrate 28 is preferably an adhesive that is heat-cured, although an ambiently-curing adhesive will suffice. An acrylic is preferred, although other types of heat-cured adhesives performing the features of the invention can be employed. Also, the substrate 28 can be asphalt or similar type products. It is preferred that the granules 26 and substrate 28 are color-coordinated to match adjacent roofing of the building to which the rain gutter protecting device 10 is applied, thus enhancing a pleasing aesthetic appearance to the building, while performing the necessary gutter protection.

For additional protection, a clear top coat can be applied, overlying the roof-matching coating 16. The top coat can be an acrylic or any other similar material that will withstand the elements and add additional service life to the rain gutter protecting device 10.

The rain gutter protecting device 10 is formed in a series of steps. First, the elongated, continuous body 12 is fabricated, such as by roll forming, with the slots 18 and apertures 24. Once formed to the shape shown in the drawing figures, the roof-matching coating is applied, by first applying the substrate to what will become the upper surface of the rain gutter protecting device 10. The granules 26 are then embedded in the substrate 28 and, if heat curing is necessary for the substrate, that step takes place. Thereafter, before installation on a building structure, the optional clear top coat can be applied to provide additional service life to the rain gutter protecting device 10.

The protecting device 10 can be applied to a gutter already affixed to a structure, or can be applied during construction of the structure. In either case, the gutter 20 is conveniently applied to the structure, such as to facial 30 extending beneath a roof 32. The gutter protecting device 10 is then applied, with the body 12 being secured to the roof, such as being nailed or screwed thereto, with the outwardly extending flange 22 being seated directly on top of the corresponding outwardly extending flange of the gutter 20. Appropriate fasteners or other means are then used to affix the flange 22 to the corresponding flange of the gutter 20. Roofing material, shown generally at 34, may then lap partially onto the protecting device 10 as shown. Since is it preferred that the roof-matching coating 16 be similar in color to the roofing material 34, the roofing material 34 need only lap onto the protecting device 10 sufficiently to prevent any water from backing up and getting beneath the protecting device 10 at the junction thereof with the roof 32.

In addition to enhancing aesthetics, the gutter protecting device 10 also aids proper water flow. The granular coating slows water flow, allowing higher volume flows of water into the gutter 20. Also, the granular nature of the coating 16 diverts flowing water, promoting a more uniform flow of water into the trough 14 and thence into the gutter 20.

Various changes can be made to the invention without departing from the spirit thereof or scope of the following claims.

What is claimed is:

1. A rain gutter protecting device, comprising a. an elongated, continuous body adapted to be affixed proximate a roof and to extend outwardly from the roof over a rain gutter secured along one edge of the roof, and including an apertured trough oriented downwardly into the rain gutter, said body having an upper surface, and b. a roof-matching coating said upper surface of said body, said coating comprising granules embedded in a substrate secured to said body, said coating extending into said trough, said granules slowing flow of water, allowing higher flows of water into said trough, and diverting flowing water to promote a more uniform flow of water into said trough.

2. The rain gutter protecting device according to claim 1 in which said granules are stone.

3. The rain gutter protecting device according to claim 1 in which said substrate is an adhesive.

4. The rain gutter protecting device according to claim 1 in which said adhesive is heat-cured.

5. The rain gutter protecting device according to claim 1 in which said adhesive is an acrylic.

6. The rain gutter protecting device according to claim 1 in which said substrate is asphalt.

7. The rain gutter protecting device according to claim 1, including a clear top coat overlying said roof-matching coating.

8. The rain gutter protecting device according to claim 1 in which said body is metal.

9. A method of forming a coated rain gutter protecting device comprising the steps of:

a. fabricating an elongated, continuous body adapted to be affixed proximate a roof and to extend over a rain gutter secured along one edge of the roof, the body including a trough oriented downwardly into the rain gutter, and said body having an upper surface, and b. applying a roof-matching coating on said upper surface of said body, including i. applying a substrate to said upper surface, extending into said trough, and ii. embedding granules in said substrate, into said trough, c. such that said granules slow flow of water, allowing higher flows of water into said trough, and diverting flowing water to promote a more uniform flow of water into said trough.

10. The method according to claim 9, including the step of heat-curing said body after body after embedding granules in said substrate.

11. The method according to claim 10, including the further step of overlying said roof-matching coating with a clear top coat.

* * * * *